United States Patent [19]

Kocks, deceased et al.

[11] 4,078,762

[45] Mar. 14, 1978

[54] THIN-WALL MOLDS FOR CASTING ELONGATE INGOTS

[75] Inventors: Friedrich Kocks, deceased, late of Dusseldorf, Germany, by Jutta Kocks, heir, Wermelskirchen, Germany

[73] Assignee: Ali Bindernagel, Dusseldorf, Germany

[21] Appl. No.: 617,103

[22] Filed: Sep. 26, 1975

[30] Foreign Application Priority Data

Sep. 28, 1974 Germany ..... 2446505

[51] Int. Cl.[2] ..... B22D 7/06

[52] U.S. Cl. ..... 249/161; 249/165; 249/174; 249/204

[58] Field of Search ..... 249/174, 204, 79, 161, 249/165; 164/122, 282, 292

[56] References Cited

U.S. PATENT DOCUMENTS

| | | | |
|---|---|---|---|
| 2,357,780 | 9/1944 | Mueller | 249/79 |
| 3,412,785 | 11/1968 | Lorang | 164/292 |

FOREIGN PATENT DOCUMENTS

| | | | |
|---|---|---|---|
| 2,021,491 | 5/1971 | Germany | 164/111 |
| 358,697 | 10/1931 | United Kingdom | 249/79 |

*Primary Examiner*—Robert D. Baldwin

*Attorney, Agent, or Firm*—Buell, Blenko & Ziesenheim

[57] ABSTRACT

A casting chill mold is provided for producing elongate metal ingots having a length to diameter ratio in excess of 10:1 in which the wall thickness of the mold is substantially no greater than that required to enable the walls to withstand the hydrostatic pressure of the melt upon the occurrence of thermal stress. Preferably the mold is surrounded by a spaced supporting framework contacting the outer surface of the mold at spaced discrete small area points of contact.

20 Claims, 10 Drawing Figures

THIN-WALL MOLDS FOR CASTING ELONGATE INGOTS

This invention relates to molds and particularly to a chill mold for producing metal ingots, billets, or the like, such as ingots or billets having a length to diameter ratio in excess of 10:1. This means that, with an external dimension of, for example, 200 millimeters square, the length of the ingot, billet, or the like, should be at least approximately 2 m. It is preferable, however, to cast lengths of 4 to 6 m with the same cross sectional dimension, i.e. 200 millimeters square.

The invention seeks to provide lengths of approximately 8 and 10 m, again with the same external dimension, which corresponds to a length to diameter ratio of 40:1 and 50:1. Such great lengths render it possible to manufacture, for example, seamless tubes or wire in a particularly economic manner, particularly on continuously operating plant, since particularly the quantity of the unusable end portions, which are unavoidably produced, is substantially reduced by using long ingots, billets, tubular blooms, or the like, as the starting material. Furthermore, particularly great lengths of tube can be obtained and, in the case of wire, high coil weights. Furthermore there is a saving in work of deformation and the machine units required for this purpose. The small amount of work of deformation can then usually be effected using a single heat, so that there is a saving in energy and furnaces for a fresh heating operation.

Chill molds of known construction in the prior art have a wall thickness which is particularly great compared with the cross section of the cast ingot, so that its weight when empty corresponds approximately to the weight of the ingot cast therein. This large wall thickness is chosen in order to obtain rapid cooling of the ingot after casting, so that the chill mold can be removed as early as possible from the the ingot which has solidified at least on the outside. Owing to the large wall thickness, the known chill mold has a large quantity of material which is cold in the first instance and which can be heated only by a considerable amount of heat. This amount of heat is taken from the melt during and after the casting operation by flowing from the melt into the wall of the chill mold. Since the largest amount of heat is taken from the portions of the melt located in the vicinity of the wall of the chill mold, these portions of the melt are the first to solidify and form a solid outer skin which enables the chill mold to be removed even after a short period of time. In addition to absorbing the heat, the known thick walls of the chill molds also provide mechanical strength, particularly with the high thermal stress, so that the chill mold walls can withstand the external forces acting upon them, for example during tilting, turning and removing, etc., and also the static pressure of the melt.

However, these known chill molds having a large wall thickness have the disadvantage that they cannot be used for the purpose of casting ingots, billets, or the like, of particularly great length, and a length to diameter ratio of approximately 10:1 can rarely be exceeded and, in accordance with material and the shape of the chill molds, is frequently unobtainable. The reason for this resides in the appearance of longitudinal cracks, i.e. more or less deep cracks, in the surface of the ingot. In the known chill molds, these cracks are essentially formed by virtue of the fact that, during casting, the outer skin of the ingot solidifies very rapidly as a result of coming into contact with the cold thick wall of the chill mold against which it abuts firmly in the first instance. Owing to the shrinkage which occurs during cooling of the ingot, the outer shell of the block is lifted from the wall of the chill mold, so that a gap is formed therebetween. When in this state, the outer shell of the ingot is no longer supported by the wall of the chill mold and it is fractured if it is subjected to a high stress as a result of too rapid a rise in the surface level of the melt being poured and the consequent rapid increase in the hydrostatic pressure. This stress usually occurs when ingots having a length to diameter ratio in excess of approximately 10:1 are cast, since the hydrostatic pressure of the still liquid melt in the interior of the ingot is correspondingly high in the case of ingots of such a length, and the non-supported outer shell of the ingot, which is still thin, is stressed such that it fractures. Ingots having these fractures cannot be used, since the fractures cannot be eliminated even during further processing.

In order to avoid these disadvantages, it has hitherto been preferred to limit the length to diameter ratio of casting chill molds to a maximum of approximately 10:1. This in turn has the disadvantage that the ingots, billets, or the like, produced in this manner are relatively short and have to be subjected to a very extensive deformation process in order to produce elongate finished products such as wire, tubes or the like. These deformation processes are expensive not only because the cross section of the work material has to be reduced to a considerable extent by considerable elongation, but also essentially because this results in a large quantity of waste which substantially comprises the unusable severed end portions.

A feature of the invention is to provide a casting chill by means of which it is possible to manufacture ingots, billets, or the like, having a length to diameter ratio in excess of 10:1 without the above-mentioned disadvantageous longitudinal cracks occurring.

In accordance with the invention, the outer walls of a casting chill mold are thinner than the walls of a conventional chill mold, so that they are just able to withstand the hydrostatic pressure of the melt upon the occurrence of the thermal stress.

Thus the quantity of material in the chill walls can be minimized and, in any event, it is less than that of the known chill molds, and thus the quantity of heat, flowing from the melt into the walls of the chill mold immediately after casting, is correspondingly less. Consequently, the cooling of the outer shell of the ingot takes place more slowly, and the temperature difference between the outer shell of the ingot and the interior of the ingot during the solidifying process is not as great as when using the known casting chill molds. At the instant at which the outer shell of the ingot has solidified to an extent that cracks could occur, in the prior art practice, and as a result of this lower temperature difference during the solidifying operation, a layer of solid or semi-solid material, increasing towards the interior of the ingot, has already formed and, although it is hotter than the outer shell of the ingot and thus does not have quite the same solidity of the outer shell, is sufficiently stable to absorb at least a portion of the hydrostatic pressure of the melt in the core of the ingot and thus to substantially relieve the outer shell of the ingot when it is lifted from the wall of the chill mold during the shrinking process occurring at the same time. The outer skin of the ingot thus relieved to a large extent can no longer fracture, and an ingot, billet, or the like, having a satisfactory surface is obtained.

Since, for the reasons given above, the hydrostatic pressure of the melt can be withstood substantially better by the outer shell of the ingot during the solidifying process, it is also possible for the outer shell of the ingot to be stressed to a greater extent by the hydrostatic pressure without cracks appearing. Consequently, ingots, billets, or the like, of substantially greater length can be cast by means of the chill mold in accordance with the invention, and length to diameter ratios of 20:1 to 50:1 can be obtained, and possibly even greater ratios. Advantageously, ingots, billets, or the like, having such dimensions avoid a considerable portion of the work of deformation when manufacturing elongate stock so that, in addition to saving labour and energy, the units for further processing can be simpler, shorter, and thus less expensive. Furthermore, owing to the longer starting material, fewer scarcely end portions are produced and thus the proportion of waste is considerably reduced in an economic manner.

In a preferred embodiment of the invention, the chill mold receiving the melt is surrounded at some radial distance therefrom by a supporting framework which is in contact with the outer surface of the chill mold only at a number of small-area, preferably punctiform places of contact. In this manner, a particularly thin-walled and long chill mold can be used without the risk of deformation or fracture of the chill mold. The mechanical stresses acting upon the chill mold are largely absorbed by the support frame which can be of relatively stable construction, so that it meets all requirements. The quantity of material required for the support frame has scarcely any effect on the cooling process of the melt, since the small-area, punctiform places of contact can transfer only a small amount of heat from the thin-walled chill mold to the support frame. The amount of heat transferred is so small that it cannot cause the disadvantageous rapid cooling of the outer shell of the block, such as occurs with the known chill molds. On the other hand, the small-area, preferably punctiform places of contact, which are distributed uniformly over the outer surfaces of the chill mold, support the thin-walled chill mold such that there is no risk of deformation or even fracture of the chill mold as a result of mechanical stresses or as a result of the hydrostatic pressure.

It is advantageous if the contact elements between the support frame and the chill mold are bolts, screws, or the like, which extend approximately radially and whose end faces support the wall of the chill mold. The chill mold can be accurately supported within the support frame by such support elements without local, inadmissibly high stress peaks occurring. Furthermore, such securing means are relatively simple to manipulate and to manufacture and are thus inexpensive.

Furthermore, it is advisable to arrange thermally insulating means at the points of contact between the outer wall surfaces and the supporting members of the support frame. Such means further reduce the small amount of heat transferred to the support frame by the small-area, preferably punctiform places of contact, without impairing the quality of the support for the chill mold.

In a further development of the invention, a bottom and/or a cover can be releasably secured to the support frame to act as an end closure of the chill mold and, furthermore, the bottom and/or cover can be clamped against the respective end face of the chill mold in an axial direction. Thus, a chill mold which is closed at one end, preferably closed at both ends, is obtained by means of which it is also possible, for example, to carry out the method described in British Patent Application No. 30414/75 and, if required, other methods in which a closed chill mold is required. The fact that the bottom and/or the cover of the chill mold is secured to the support frame, and not to the chill mold itself, has the substantial advantage that accumulations of material on the fastening means on the chill mold in the region of the bottom and/or the cover are avoided which fastening means otherwise would have to be mounted for securing the bottom and the cover, which might for example take the form of hinges, retaining spindles or the like. Such accumulations of material would be equivalent to a thickening of the chill mold wall at this location, so that, as in the known constructions, a greater amount of heat would be taken from the melt at this location, so that the melt would be cooled more rapidly, even if only locally and to a limited extent. This disadvantageous, non-uniform cooling of the melt is avoided by securing the bottom and the cover to the support frame. The bottom and/or the cover is in contact with the chill mold only at the narrow end faces and only by means of its refractory lining which, in any case, has only a small amount of thermal conductivity. Furthermore, this embodiment has the advantage that the thin-walled chill mold is provided with a simple, tubular shape and is inexpensive to manufacture and can be rapidly exchanged. It is even possible, after appropriate cooling of the melt, to push the ingot, together with the chill mold, out of the support frame and to introduce a fresh chill mold into the relevant support frame for the next casting operation.

The clamping means for clamping the bottom and/or the cover against the end faces of the chill mold can comprise wedge members. Furthermore, it is possible to subject the clamping means to the stress forces of spring elements. This ensures uniform contact pressure which, in turn, avoids the occurrence of local, inadmissibly high stress peaks. Furthermore, the clamping means may be releasable or clampable by means of hydraulic or pneumatic working cylinders. This facilitates the opening and the closing of the cover of the casting chill mold in particular and avoids manual work on the casting chill mold, particularly when the latter is filled with melt.

In an advantageous embodiment of the invention, the support frame comprises lattice structure, made preferably from profiled bars. A support frame of this type permits uniform air cooling of the thin-walled chill mold and, if required, even permits the use of a regulated artificial flow of coolant. On the other hand, it is also possible for the support frame to comprise a tube having a larger internal diameter than the external circumference of the chill mold. A closed tube of this type inhibits the cooling of the melt by thermal radiation and is provided particularly for melts which require particularly slow cooling. In such cases, and in accordance with a further feature of the invention, it is advisable to arrange a thermally insulating means, such as sand, between the support frame and the chill mold. It is then advantageous if the thermally insulating means at the same time serve to support the chill mold. By way of example, this is readily possible when using sand and a closed tube as a support frame. Alternatively, however, it is conceivable to use other thermally insulating means in the form of supports made from a material having poor thermal conductivity. Also it is possible for the chill mold to be surrounded at some distance therefrom by a reticulate sheet metal member or the like. This obstructs thermal radiation and retards the solidifying of the outer shell of the ingot. This retardation can be regulated by appropriate dimensioning of the holes and the distances between the holes.

The invention is further described, by way of example, with reference to the accompanying drawings, in which.

Figure 1:
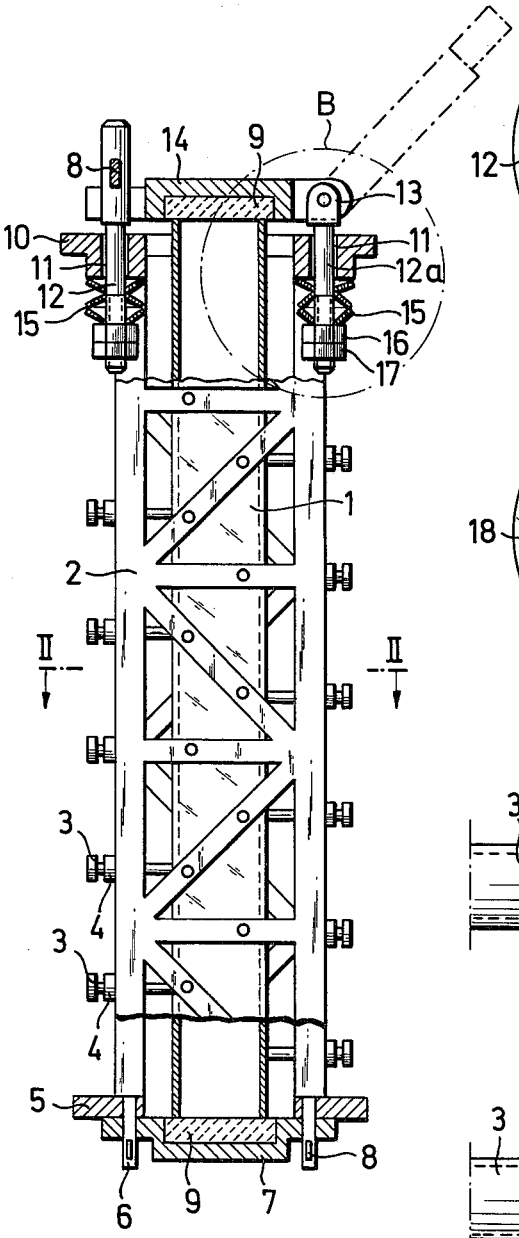
FIG. 1 is a side elevation, partially sectioned, of a casting chill mold in accordance with the invention.

Referring to FIG. 1, a tubular chill mold 1 has a relatively small wall thickness compared with that of conventional chill molds. The chill mold is surrounded at some distance therefrom by a support frame 2 which comprises a profiled bar structure, square-section tubes in the present instance. Screws 3 are distributed around the outer surfaces of the chill mold 1 and are screwed into the support frame 2 and locked by means of lock nuts 4. The end faces of the screws 3 engage the outer wall surface of the chill mold 1 to support the chill mold 1.

The bottom end portion of the support frame 2 has a flange 5 and at least two bolts 6 for holding a bottom 7. The bottom 7 has bores through which the bolts 6 extend, and the bottom 7 is pressed against the flange 5 by means of wedges 8 which are driven into slots provided in the bolts 6. The bottom 7 has a refractory lining 9 on which the chill mold 1 rests.

Figure 3:
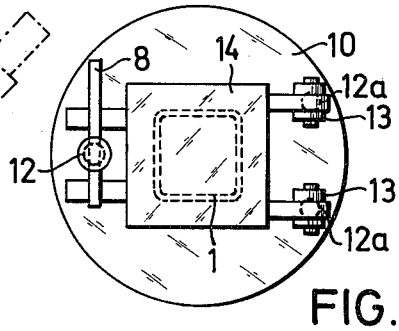
FIG. 3 is a plan view of the chill mold illustrated in FIG. 1.

The top end portion of the mold support frame also has a flange 10 which, like the flange 5, is rigidly connected to the support frame 2 by welding. The flange 10 has three bores 11 through which respective bolts 12 and **12*a* extend. The arrangement of the bolts 12 and 12*a* may be seen in FIG. 3. The bolt 12*a* has a bifurcated head 13 which serves as a hinge portion for a cover 14 which, like the bottom 7, is provided with a refractory lining 9. For the purpose of pouring the melt into the chill mold 1, the cover 14 can be swung upwardly into the position shown by dash-dot lines. After the casting operation, the chill mold 1 is closed by means of the cover 14, as is shown by solid lines in FIG. 1. The cover 14 is locked by means of a wedge 8 in the same manner as the bottom 7. However, the cover 14 is pressed against the end face of the chill mold 1 and not against the flange 10. In order to maintain the contact pressure substantially constant, and to render it possible to provide longitudinal compensation of the chill mold 1 relative to the support frame 2, cup springs 15 are arranged below the flange 10 and surround the bolts 12 and 12*a*. Nuts 16 and lock nuts 17, screwed onto the bolts 12 and 12*a***, act as abutments.

Figure 2:
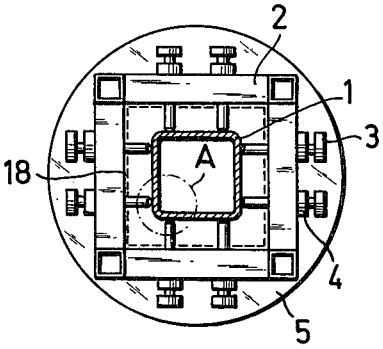
FIG. 2 is a section taken on the line II—II of FIG. 1.

FIG. 2 shows the arrangement of the screws 3 around the cross section of the chill mold 1 which is approximately square. Furthermore, a perforated sheet metal member 18 is indicated in this Figure; this member has been omitted in FIG. 1 for the sake of clarity. The perforated sheet metal member 18 is intended to obstruct thermal radiation but is not required and therefore not provided in every embodiment of the invention. It forms a thermally insulating means which, alternatively, can comprise sand if the support frame 2 is closed on all sides to form a tube rather than the open lattice structure illustrated.

Figure 4:
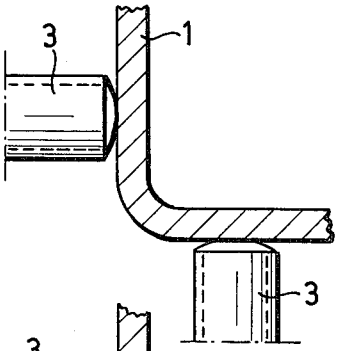
FIG. 4 is a fragmentary view of the portion A of FIG. 2, drawn to a larger scale.
Figure 5:
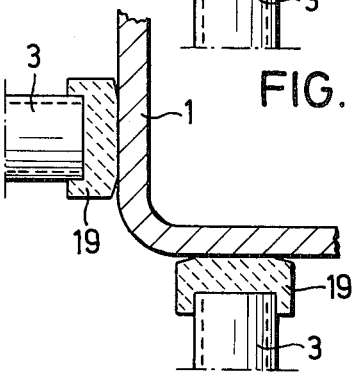
FIG. 5 is a section, corresponding to FIG. 4, through a different embodiment.

It will be seen from FIG. 4 that the screws 3 only allow a small, substantially punctiform contact point, and thus a small substantially punctiform heat transfer point, on the wall of the chill mold 1 which transfers only a small amount of heat. In the embodiment illustrated in FIG. 5, the screws 3 are provided with caps 19 made from a thermally insulating material.

Figure 6:
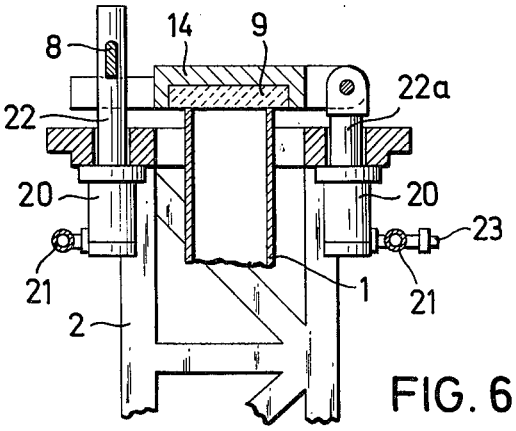
FIG. 6 is a detail sectional view, corresponding approximately to the upper portion of FIG. 1, but illustrating a different embodiment.

The cup springs 15 are not shown in the embodiment illustrated in FIG. 6, since they are arranged in commercially available clamping cylinders 20. These clamping cylinders operate pneumatically or hydraulically and they are acted upon by pressure medium by way of a ring conduit 21 which surrounds the support frame 2.

As soon as pressure is admitted to the clamping cylinders, the piston rods designated 22 and **22*a* (which replace the bolts 12 and 12*a*, respectively, of FIG. 1) are lifted against the action of the springs provided in the clamping cylinders 20. As a result of the lifting of the piston rods 22 and 22*a*, the cover 14 rests only loosely on the top end face of the chill mold 1, so that the wedge 8, which, if required, may be replaced by a simple rod, can be removed. The cover 14 can then be swung upwardly. The cover 14 is closed again after the casting operation, the wedge 8 is inserted and the ring conduit 21 and thus the clamping cylinders 20 are relieved of pressure by way of a relief valve 23. The spring elements located in the clamping cylinders 20 pull the piston rods 22 and 22*a* downwardly and the refractory lining 9 of the cover 14 is pressed firmly against the top end face of the chill mold 1**.

Figure 7:
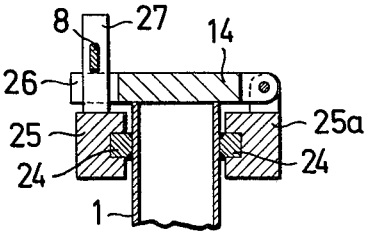
FIG. 7 is a detail sectional view of a further embodiment of cover fastening.
Figure 8:
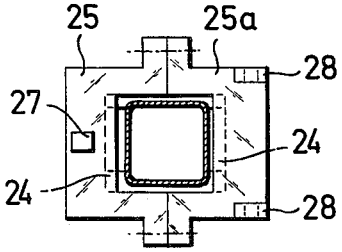
FIG. 8 is a plan view of the embodiment of cover fastening of FIG. 7.

A particularly simple embodiment of the cover closure is illustrated in FIGS. 7 and 8,. Here, the cover 14 is secured to the chill mold 1 and not to the support frame 2. Two extensions 24, whose volume of material is as small as possible, are welded to the chill mold 1 in the vicinity of the top edge thereof. A flange comprising two parts 25 and **25*a* embraces the extensions 24 such that the flange does not touch the chill mold 1 itself. One half 25 of the flange has a bolt 27 which engages through a slot 26 in the cover 14, and the other half 25*a* of the flange has two hinge members 28 in which the cover 14 is pivotally mounted. The cover 14, omitted from FIG. 8, is locked by means of the wedge 8 shown in cross section in FIG. 7**.

Figure 9:
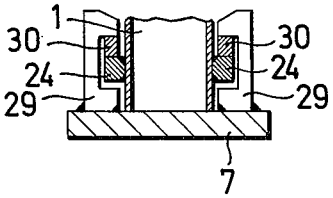
FIG. 9 is a detail sectional view of a different embodiment of bottom fastening.
Figure 10:
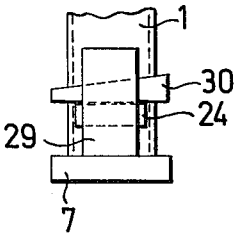
FIG. 10 is a side elevation of the embodiment of bottom fastening of FIG. 9.

FIGS. 9 and 10 show a corresponding method of securing the bottom 7, also by means of extensions 24. Here, the bottom 7 is equipped with holders 29 which do not touch the chill mold 1 but which render it possible to press the bottom 7 firmly against the bottom end face of the chill mold 1 by means of wedges 30. By virtue of using the extensions 24, only the quantity of heat transferred by the extensions 24 can flow from the chill mold 1. It is then also possible to provide thermal insulation between the extensions 24 and the members acting upon them, so that any further flowing-away of heat is largely prevented.

In the foregoing specification, certain preferred practices and embodiments of this invention have been set out, however, it will be understood that this invention may be otherwise embodied within the scope of the following claims.

I claim:

1. A chill casting apparatus for producing metal ingots, billets, or the like, such as ingots or billets having a length to diameter ratio in excess of 10:1, consisting essentially of a single wall chill mold in which the thickness of the wall of the chill mold is substantially no greater than that required to enable the wall to withstand the hydrostatic pressure of the melt upon the occurrence of the thermal stress accompanying pouring of the melt, a bottom closure member on said mold, and intermediate support means including non-heat transferring means contacting the mold spaced along the length and perimeter of the mold.

2. A casting chill mold as claimed in claim 1, wherein the single wall mold is surrounded by radial spaced supporting framework which is in contact with the outer surfaces of the chill mold only at spaced discrete small-area points of contact along the length and perimeter of the mold, forming the support means.

3. A casting chill mold as claimed in claim 2 in which a bottom is releasably secured to the support frame and means are provided on said frame for clamping said bottom axially against the lower end of the chill mold to act as an end closure therefor.

4. A casting chill mold as claimed in claim 3 in which the clamping means comprise wedge members.

5. A casting chill mold as claimed in claim 3 in which the clamping means are subject to the stress of spring elements.

6. A casting chill mold as claimed in claim 3 in which the clamping means are releasable or clampable by means of fluid operated working cylinders.

7. A casting chill mold as claimed in claim 2 in which a cover is releasably secured to the support frame and means are provided on said frame for clamping said cover axially against the upper end of the chill mold to act as an end closure therefor.

8. A casting chill mold as claimed in claim 7 in which the clamping means comprise wedge members.

9. A casting chill mold as claimed in claim 7 in which the clamping means are subject to the stress of spring elements.

10. A casting chill mold as claimed in claim 7 in which the clamping means are releasable or clampable by means of fluid operated working cylinders.

11. A casting chill mold as claimed in claim 2 in which the support frame comprises a lattice structure.

12. A chill mold as claimed in claim 11 in which the lattice structure comprises profiled bars.

13. A casting chill mold as claimed in claim 11 in which the chill mold is surrounded at a distance therefrom by a reticulate sheet metal member or the like.

14. A casting chill mold as claimed in claim 2 in which the support frame comprises a tube having a larger internal diameter than the external circumference of the chill mold.

15. A casting chill mold as claimed in claim 2 in which a thermally insulating medium is arranged between the support frame and the chill mold.

16. A casting chill mold as claimed in claim 15 in which the thermally insulating medium at the same time serves to support the chill mold.

17. A chill casting apparatus for producing metal ingots, billets, or the like, such as ingots or billets having a length to diameter ratio in excess of 10:1, consisting essentially of a single wall chill mold in which the thickness of the wall of the chill mold is substantially no greater than that required to enable the wall to withstand the hydrostatic pressure of the melt upon the occurrence of the thermal stress accompanying pouring of the melt, a bottom closure member on said mold, said mold being surrounded by radial spaced supporting framework which is in contact with the outer surfaces of the chill mold only at spaced discrete small-area points of contact, said points of contact being punctiform and spaced along the length and perimeter of the mold.

18. A chill casting apparatus for producing metal ingots, billets, or the like, such as ingots or billets having a length to diameter ratio in excess of 10:1, consisting essentially of a single wall chill mold in which the thickness of the outer walls of the chill mold is substantially no greater than that required to enable the walls to withstand the hydrostatic pressure of the melt upon the occurrence of the thermal stress accompanying pouring of the melt, a bottom closure member on said mold, said mold being surrounded by radial spaced supporting framework which is in contact with the outer surfaces of the chill mold only at spaced discrete small-area points of contact along the length and perimeter of the mold, and thermally insulating means arranged at the points of contact between the outer wall surfaces of the mold and the said contact points.

19. A chill casting apparatus for producing metal ingots, billets, or the like, such as ingots or billets having a length to diameter ratio in excess of 10:1, consisting essentially of a single wall chill mold in which the thickness of the wall of the chill mold is substantially no greater than that required to enable the wall to withstand the hydrostatic pressure of the melt upon the occurrence of the thermal stress accompanying pouring of the melt, a bottom closure member on the mold, said mold being surrounded by radial spaced supporting framework which is in contact with the outer surfaces of the chill mold only at spaced discrete small-area points of contact, said points of contact being formed by the ends of bolts, screws and the like arranged between the support frame and the chill mold so that their end faces support the outer wall surface of the chill mold, and spaced along the length and perimeter of the mold.

20. A casting chill mold as claimed in claim 19 wherein thermally insulating means are arranged between the outer mold wall surfaces and the ends of the bolts, screws and like contact elements of the support frame.

* * * * *

UNITED STATES PATENT OFFICE

CERTIFICATE OF CORRECTION

Patent No. 4,078,762 Dated March 14, 1978

Inventor(s) Friedrich Kocks, deceased

It is certified that error appears in the above-identified patent and that said Letters Patent are hereby corrected as shown below:

Column 3, line 19, "scarcely" should be --unusable--.

Column 6, line 48, after "8" delete the comma.

Signed and Sealed this

*Twenty-sixth* Day of *September 1978*

[SEAL]

*Attest:*

RUTH C. MASON
*Attesting Officer*

DONALD W. BANNER
*Commissioner of Patents and Trademarks*